US011198495B2

(12) United States Patent
Fujima et al.

(10) Patent No.: US 11,198,495 B2
(45) Date of Patent: Dec. 14, 2021

(54) BOAT MANEUVERING SUPPORT DEVICE AND OUTBOARD MOTOR

(71) Applicant: HONDA MOTOR CO., LTD., Tokyo (JP)

(72) Inventors: Akifumi Fujima, Saitama (JP); Takashi Hashizume, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/968,780

(22) PCT Filed: Feb. 15, 2018

(86) PCT No.: PCT/JP2018/005327
§ 371 (c)(1),
(2) Date: Aug. 10, 2020

(87) PCT Pub. No.: WO2019/159289
PCT Pub. Date: Aug. 22, 2019

(65) Prior Publication Data
US 2020/0398964 A1 Dec. 24, 2020

(51) Int. Cl.
*B63H 25/02* (2006.01)
*B63H 25/42* (2006.01)

(52) U.S. Cl.
CPC ..... *B63H 25/02* (2013.01); *B63H 25/42* (2013.01); *B63H 2025/022* (2013.01)

(58) Field of Classification Search
CPC ... B63H 25/02; B63H 25/42; B63H 2025/043
See application file for complete search history.

(56) References Cited

U.S. PATENT DOCUMENTS 7,601,040 B2 * 10/2009 Morvillo ..... B63H 21/21 440/1
8,678,869 B2 * 3/2014 Morvillo ..... B63H 25/02 440/41

(Continued)

FOREIGN PATENT DOCUMENTS

JP S59-096096 A 6/1984
JP 2002-234495 A 8/2002

(Continued)

OTHER PUBLICATIONS

Apr. 17, 2018, International Search Report issued for related PCT Application No. PCT/JP2018/005327.

(Continued)

*Primary Examiner* — S. Joseph Morano
*Assistant Examiner* — Jovon E Hayes
(74) *Attorney, Agent, or Firm* — Paratus Law Group, PLLC

(57) ABSTRACT

A boat maneuvering support device supports maneuvering of a boat including a first propulsion device having a variable turning angle, a second propulsion device for generating a propulsive force for moving the boat in a left-right direction, and a steering mechanism for changing a turning angle of the first propulsion device and an output of the second propulsion device. The boat maneuvering support device includes a control unit which controls the turning angle of the first propulsion device and/or the output of the second propulsion device, a detection unit which detects a rotational speed of a propeller of the first propulsion device, and a calculation unit which obtains a rotational power of the boat based on the turning angle designated by the operation of the steering mechanism and the rotational speed. The control unit controls the output of the second propulsion device based on the rotational power.

7 Claims, 7 Drawing Sheets

(56) References Cited

U.S. PATENT DOCUMENTS

| | | | | |
|---|---|---|---|---|
| 2003/0079668 | A1* | 5/2003 | Morvillo | B63H 11/11 114/151 |
| 2006/0121803 | A1* | 6/2006 | Morvillo | B63H 25/02 440/41 |
| 2008/0189001 | A1* | 8/2008 | Morvillo | B63H 11/107 701/21 |
| 2014/0046515 | A1 | 2/2014 | Mizutani | |
| 2016/0096611 | A1 | 4/2016 | Suzuki et al. | |
| 2020/0255103 | A1* | 8/2020 | Yamamoto | B63B 79/10 |
| 2020/0398964 | A1* | 12/2020 | Fujima | B63H 25/02 |

FOREIGN PATENT DOCUMENTS

| | | | |
|---|---|---|---|
| JP | 2008-174173 | A | 7/2008 |
| JP | 2008-184127 | A | 8/2008 |
| JP | 2014-034269 | A | 2/2014 |
| JP | 2014-113918 | A | 6/2014 |
| JP | 2016-074250 | A | 5/2016 |

OTHER PUBLICATIONS

Apr. 17, 2018, International Search Opinion issued for related PCT Application No. PCT/JP2018/005327.

* cited by examiner

BOAT MANEUVERING SUPPORT DEVICE AND OUTBOARD MOTOR

CROSS REFERENCE TO PRIOR APPLICATION

This application is a National Stage Patent Application of PCT International Patent Application No. PCT/JP2018/005327 (filed on Feb. 15, 2018) under 35 U.S.C. § 371, which is hereby incorporated by reference in their entirety.

TECHNICAL FIELD

The present invention relates to a boat maneuvering support device for supporting maneuvering of a boat and an outboard motor including the same.

BACKGROUND ART

Patent Document 1 discloses a boat including an outboard motor mounted on a rear portion of a hull and thrusters provided at front and rear of the hull to move the hull in a left-right direction. In this boat, an operation of the outboard motor and an operation of the thruster can be performed by operating a steering wheel.

CITATION LIST

Patent Document
Patent Document 1: JP-A-2016-74250

SUMMARY OF INVENTION

Technical Problem

As described in Patent Document 1, in a case where a plurality of turning mechanisms (the outboard motor and the thruster) are operated by operating one steering mechanism such as the steering wheel, if an output of the thruster is determined only in consideration of an operating state of the steering mechanism, it is possible that accurate turning cannot be performed or unnecessary turning may be performed depending on a traveling state of the boat.

Patent Document 1 does not consider how the output of the thruster should be controlled.

The present invention has been made in view of the above circumstances, and an object thereof is to provide a boat maneuvering support device that is capable of performing stable and accurate turning in a case where a single steering mechanism is operated to perform turning of a boat, and an outboard motor including the same.

Solution to Problem

According to an embodiment of the present invention, there is provided a boat maneuvering support device configured to support maneuvering of a boat including: a first propulsion device which is mounted on a stern of the boat and has a variable turning angle, a second propulsion device which is mounted on the boat and is configured to generate a propulsive force for moving the boat in a left-right direction; and a steering mechanism configured to change a turning angle of the first propulsion device and an output of the second propulsion device. The boat maneuvering support device includes a control unit configured to control at least one of the turning angle of the first propulsion device and the output of the second propulsion device according to an operation of the steering mechanism, a rotational speed detection unit configured to detect a rotational speed of a propeller included in the first propulsion device, and a rotational power calculation unit configured to obtain a rotational power of the boat based on the turning angle designated by the operation of the steering mechanism and the rotational speed. The control unit is configured to control the output of the second propulsion device based on the rotational power.

An outboard motor according to an embodiment of the present invention includes the boat maneuvering support device.

Advantageous Effects of Invention

According to the present invention, the stable and accurate turning can be performed in a case where a single steering mechanism is operated to perform the turning of the boat.

DESCRIPTION OF EMBODIMENTS

Hereinafter, an embodiment of the present invention will be described with reference to the drawings.

Figure 1:
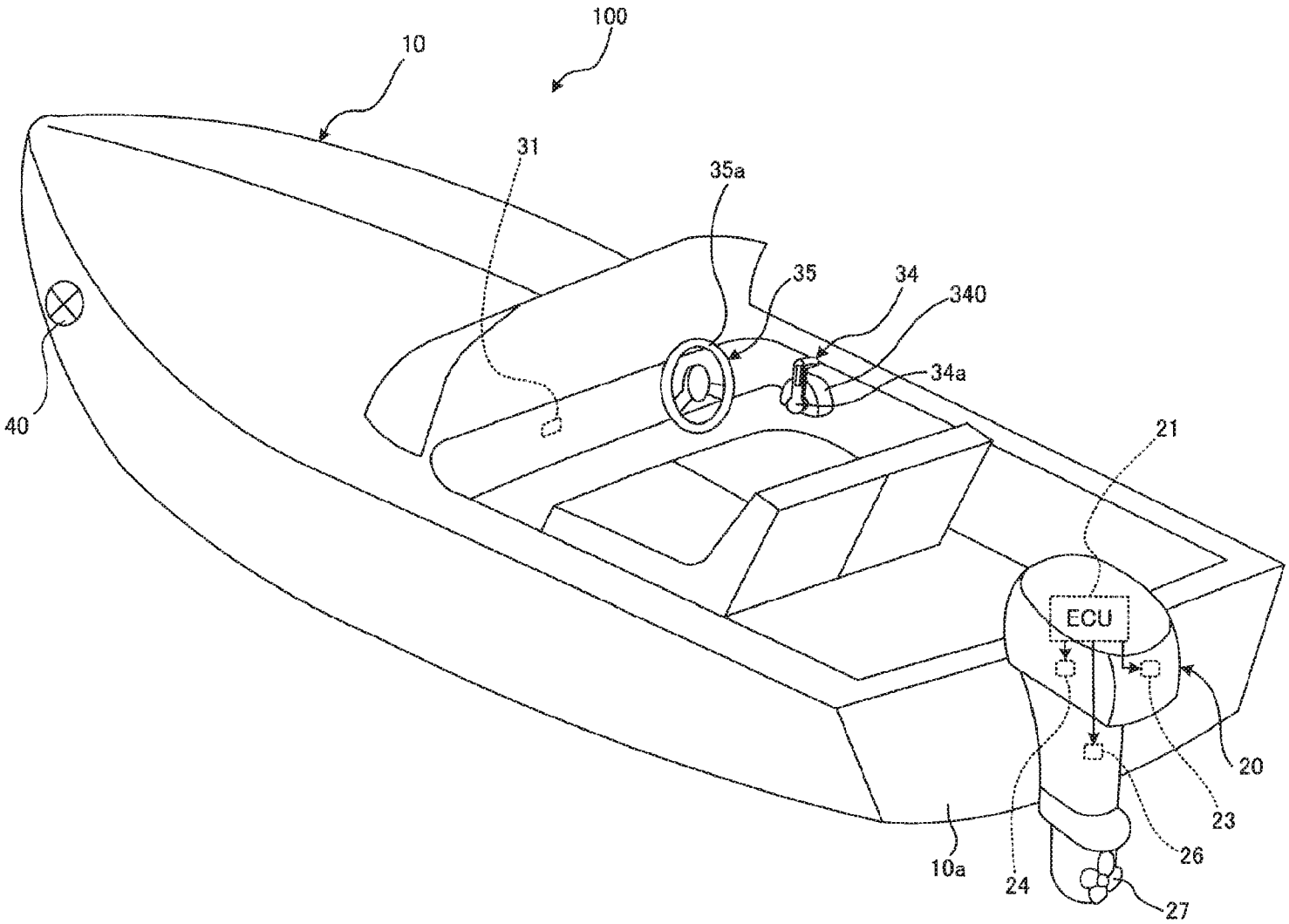
FIG. 1 is a schematic view showing an external configuration of a boat including an electronic control unit (ECU), which is a boat maneuvering support device according to an embodiment of the present invention.

FIG. 1 is a schematic view showing an external configuration of a boat 100 including an electronic control unit (ECU) 21, which is a boat maneuvering support device according to an embodiment of the present invention.

The boat 100 includes a hull 10, an outboard motor 20 which is mounted on a stern 10*a* of the hull 10 and has a variable turning angle and which constitutes a first propulsion device, a thruster 40 which is mounted on a bow of the hull 10 and configured to generate a propulsive force for moving the hull 10 in a left-right direction and which constitutes a second propulsion device, a global positioning system (GPS) receiver 31 provided on the hull 10, a shift and throttle operating device 34, and a steering device 35 which constitutes a steering mechanism.

The GPS receiver 31 receives a signal from a GPS satellite and transmits the received signal to the ECU 21.

The thruster 40 includes a thruster motor (not shown), and a propeller (not shown) which rotates by power from the thruster motor. The thruster motor of the thruster 40 is controlled by the ECU 21.

The outboard motor 20 includes the ECU 21, an internal combustion engine (not shown), a propeller 27 which rotates by power from the internal combustion engine, a throttle motor 23, a turning motor 24, and a shift motor 26.

The throttle motor 23 is an actuator for opening and closing a throttle valve of the internal combustion engine.

The turning motor 24 is an actuator for driving a turning mechanism which rotates the outboard motor 20 around a vertical axis and changes an orientation of the outboard motor 20 with respect to a direction connecting the bow and the stern 10*a* of the hull 10.

The shift motor 26 is an actuator for driving a shift mechanism which switches a rotational direction of the propeller 27 forward and reverse.

The ECU 21, the GPS receiver 31, the shift and throttle operating device 34, and the steering device 35 can communicate with each other by wired communication or wireless communication.

The ECU 21, the GPS receiver 31, the shift and throttle operating device 34, and the steering device 35 are connected by a communication method (for example, NMEA2000, specifically a controller area network (CAN)) standardized by National Marine Electronics Association (NMEA), for example.

The shift and throttle operating device 34 includes a rotary shaft (not shown) rotatably supported inside a remote control box 340 provided in the vicinity of an operator seat, a shift and throttle lever 34*a* which is attached to the rotary shaft and freely swings from an initial position in a front-rear direction, and a lever position sensor (not shown) provided inside the remote control box 340.

The lever position sensor detects an operating position (a rotational angle of the rotary shaft of the shift and throttle operating device 34) of the shift and throttle lever 34*a* by an operator, and outputs a signal corresponding to the operating position. The signal output from the lever position sensor is transmitted to the ECU 21.

The rotational angle is, for example, 0 degrees in a state where the shift and throttle lever 34*a* is in the initial position, changes up to, for example, 90 degrees in a state where the shift and throttle lever 34*a* is tilted forward from the initial position, and changes up to, for example, −90 degrees in a state where the shift and throttle lever 34*a* is tilted rearward from the initial position.

An absolute value of the rotational angle of the rotary shaft of the shift and throttle operating device 34 and a throttle valve opening degree of the internal combustion engine of the outboard motor 20 are managed in association with each other.

When the ECU 21 receives a signal corresponding to the rotational angle of the rotary shaft of the shift and throttle operating device 34, the ECU 21 controls the throttle motor 23 such that the throttle valve opening degree becomes a value corresponding to the absolute value of the rotational angle. As the absolute value of the rotational angle of the rotary shaft of the shift and throttle operating device 34 increases, the throttle valve opening degree is controlled to be larger, and a rotational speed of the propeller 27 is larger.

A sign (a rotational direction of the shift and throttle lever 34*a*) of the rotational angle of the rotary shaft of the shift and throttle operating device 34 and the rotational direction of the propeller 27 are managed in association with each other.

For example, a rotational angle whose sign is plus is associated with a forward rotational direction of the propeller 27, and a rotational angle whose sign is minus is associated with a reverse rotational direction of the propeller 27. The hull 10 moves forward when the propeller 27 rotates in the forward direction, and the hull 10 moves backward when the propeller 27 rotates in the reverse direction.

When the ECU 21 receives a signal corresponding to the rotational angle of the rotary shaft of the shift and throttle operating device 34, the ECU 21 controls the shift motor 26 such that the rotational direction of the propeller 27 corresponds to the rotational direction of the rotary shaft. When the shift and throttle lever 34*a* is set to the initial position, a gear of the shift mechanism included in the outboard motor 20 is in a neutral state, and the propeller 27 is not driven.

The steering device 35 includes a steering wheel 35*a* which is rotatable around a shaft as a rotation axis, and a steering angle sensor (not shown) which is provided in the vicinity of the shaft and configured to detect a steering angle of the steering wheel 35*a* and output a signal corresponding to the steering angle. The signal corresponding to the steering angle output from the steering angle sensor is transmitted to the ECU 21.

The steering angle of the steering wheel 35*a* and a rotational angle (a turning angle) around the vertical axis of the outboard motor 20 are managed in association with each other. When the ECU 21 receives a signal corresponding to the steering angle of the steering wheel 35*a*, the ECU 21 controls the turning motor 24 such that the turning angle of the outboard motor 20 becomes a value corresponding to the steering angle.

Figure 2:
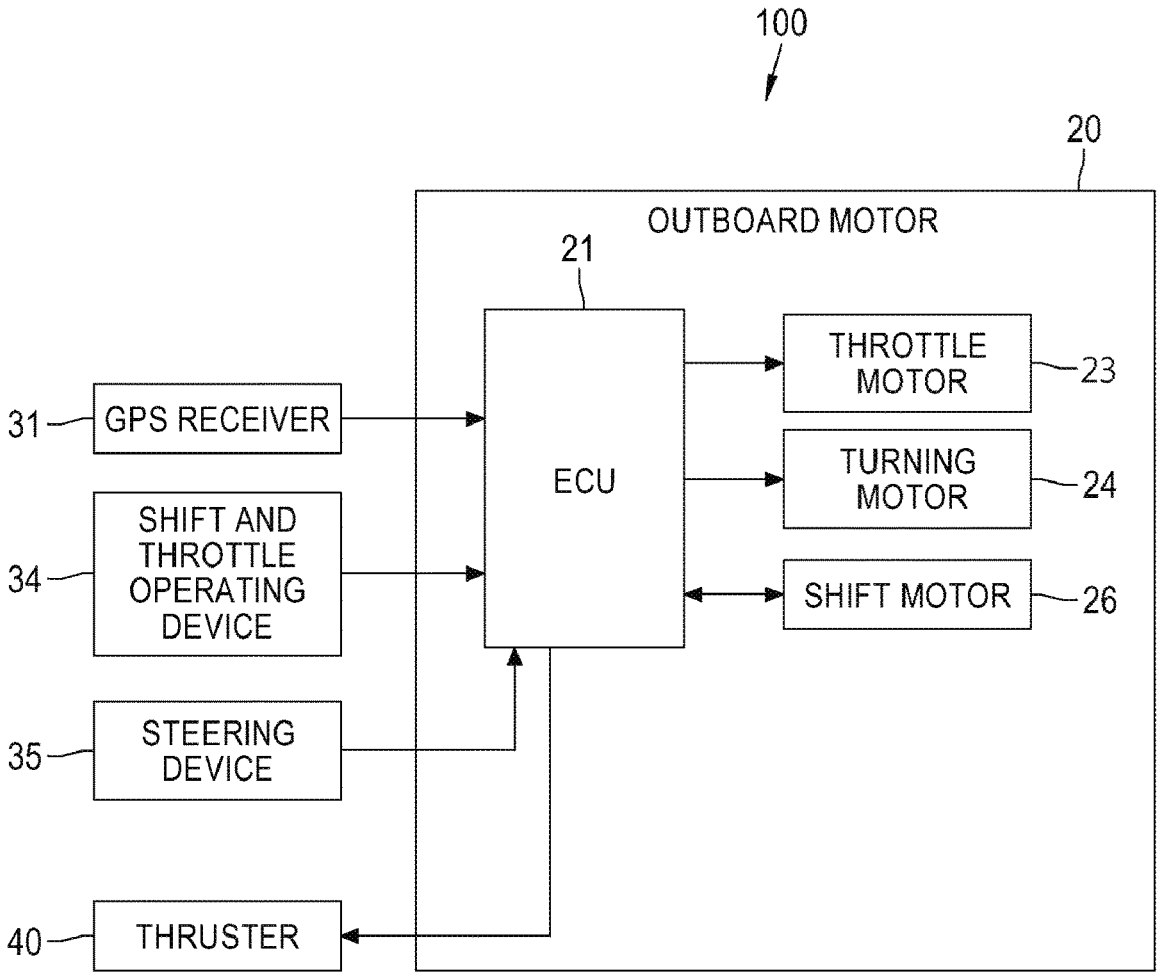
FIG. 2 is a block diagram showing a main configuration of hardware of the boat shown in FIG. 1.

FIG. 2 is a block diagram showing a main configuration of hardware of the boat 100 shown in FIG. 1.

The outboard motor 20 includes the ECU 21, the throttle motor 23, the turning motor 24, and the shift motor 26. Although not shown in FIG. 2, the outboard motor 20 further includes the internal combustion engine, the turning mechanism, the shift mechanism, the propeller 27 (see FIG. 1), or the like.

The ECU 21 includes various processors which execute programs to perform processes, a random access memory (RAM), and a read only memory (ROM). A rotational power (hereinafter referred to as a required rotational power) of the boat 100 required for turning the hull 10 is stored in the ROM in advance. The required rotational power is a value determined by a size of the hull 10 or the like.

The various processors described above may include a central processing unit (CPU) which is a general-purpose processor configured to execute programs to perform various processes, a programmable logic device (PLD) such as an field programmable gate array (FPGA) which is a processor whose circuit configuration can be changed after manufacture, a dedicated electric circuit such as an application specific integrated circuit (ASIC) which is a processor having a circuit configuration specifically designed for executing a specific process.

Specifically, structures of these various processors are electric circuits in which circuit elements such as semiconductor elements are combined.

The processors of the ECU 21 may be configured by one of various processors, or may be a combination of two or more processors of the same type or different types (for example, a combination of a plurality of FPGAs or a combination of a CPU and an FPGA).

Figure 3:
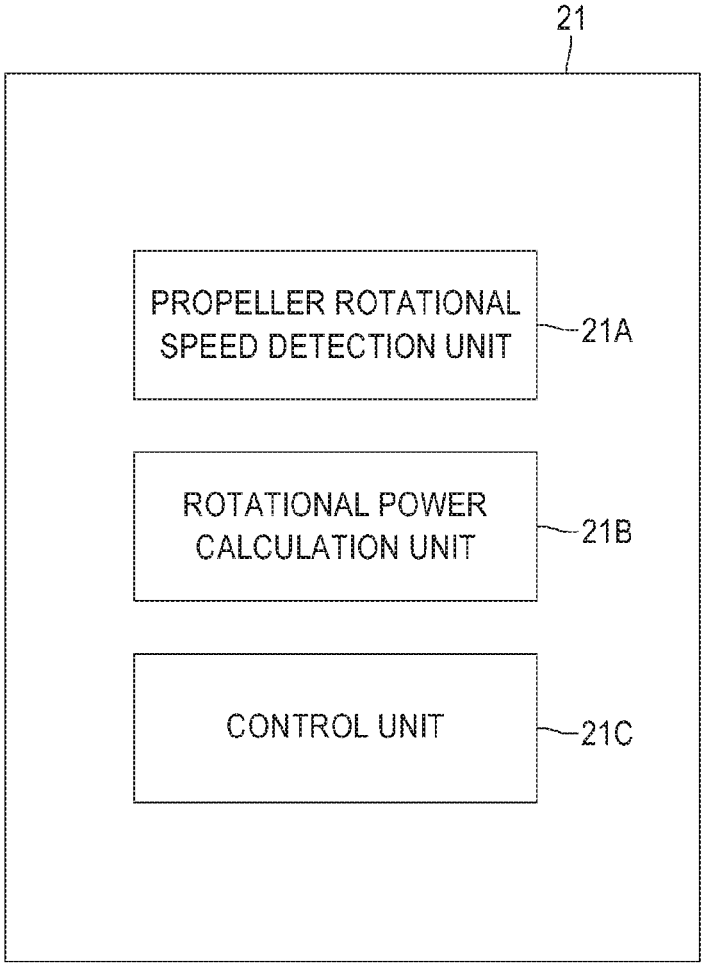
FIG. 3 shows functional blocks of the ECU shown in FIG. 2.

FIG. 3 shows functional blocks of the ECU 21 shown in FIG. 2.

The ECU 21 functions as a propeller rotational speed detection unit 21A, a rotational power calculation unit 21B, and a control unit 21C by the processor executing a program stored in the built-in ROM and cooperating with various hardware of the outboard motor 20 and the boat 100.

The propeller rotational speed detection unit 21A detects the rotational speed of the propeller 27 included in the outboard motor 20.

The propeller rotational speed detection unit 21A calculates the rotational speed of the propeller 27 based on information on the rotational speed of the propeller 27 transmitted from a sensor which is attached to a shaft of the propeller 27 and detects the rotational speed.

The rotational power calculation unit 21B obtains the rotational power of the boat 100 based on the turning angle of the outboard motor 20 designated by an operation of the steering device 35 and the rotational speed calculated by the propeller rotational speed detection unit 21A.

Specifically, when the rotational speed of the propeller 27 is denoted as V, $\alpha$ represents a constant unique to the propeller 27 determined by the propeller 27, and the turning angle of the outboard motor 20 designated by the operation of the steering device 35 is denoted as $\theta$, the rotational power calculation unit 21B obtains a rotational power F of the boat 100 by the following equation (1).

$$F = V \times \alpha \times \sin\theta \quad (1)$$

"$V \times \alpha$" in the equation (1) corresponds to a force of the hull 10 to turn. When the rotational speed V is large, that is, the boat 100 is accelerating, the outboard motor 20 strongly pushes water in a desired direction of turning. Therefore, the force which the hull 10 tends to turn becomes large.

On the other hand, when the rotational speed V is small, that is, the boat 100 is decelerating, the outboard motor 20 pushes less water in a desired direction of turning. Therefore, the force which the hull 10 tends to turn becomes small. Therefore, when the boat 100 is decelerating, the rotational power F obtained by the equation (1) may not reach the required rotational power described above.

The control unit 21C controls at least one of the turning angle of the outboard motor 20 and an output of the thruster 40 according to the operation of the steering device 35.

Specifically, when the steering device 35 is operated and a predetermined turning angle is designated, the control unit 21C compares the rotational power F calculated by the rotational power calculation unit 21B based on the turning angle and the rotational speed of the propeller 27 at time when the steering device 35 is operated and the required rotational power stored in the ROM.

When the rotational power F is equal to or greater than the required rotational power, the control unit 21C determines that the hull 10 can turn without operating the thruster 40, controls the turning motor 24 such that the turning angle becomes the designated turning angle so as to control the turning angle of the outboard motor 20. That is, when the rotational power F is equal to or greater than the required rotational power, the control unit 21C does not operate the thruster 40 and controls the thruster 40 to be a stopping state.

On the other hand, when the rotational power F is less than the required rotational power and the rotational power for turning the hull 10 is insufficient, the control unit 21C compensates for the insufficient amount by operating the thruster 40.

That is, when the rotational power F is less than the required rotational power, the control unit 21C controls the turning motor 24 of the outboard motor 20 to control the turning angle of the outboard motor 20, and further controls the thruster motor to operate the thruster 40 to control a propulsive force of the thruster 40. At this time, the thruster motor is controlled such that the propulsive force of the thruster 40 is equal to or greater than a rotational power obtained by subtracting the rotational power F from the required rotational power.

Figure 4:
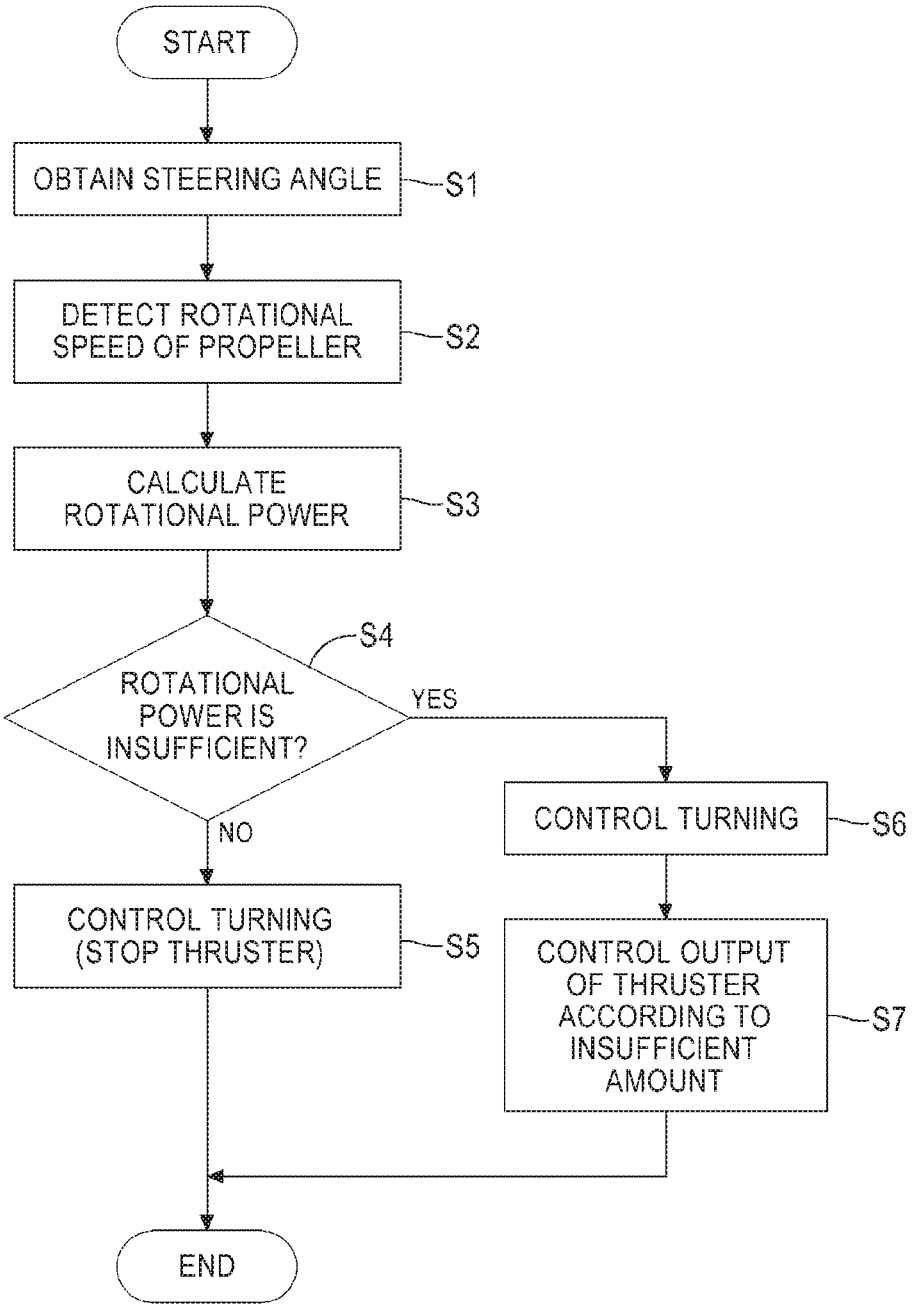
FIG. 4 is a flowchart for explaining an operation of the ECU shown in FIG. 3 when a steering device is operated.

FIG. 4 is a flowchart for explaining an operation of the ECU 21 when the steering device 35 is operated.

When the steering device 35 is operated, the rotational power calculation unit 21B of the ECU 21 obtains the steering angle of the steering device 35 (step S1).

Next, the propeller rotational speed detection unit 21A of the ECU 21 detects the rotational speed of the propeller 27 (step S2).

Next, the rotational power calculation unit 21B of the ECU 21 calculates the rotational power F of the boat 100 by the calculation of the equation (1) from the turning angle corresponding to the steering angle acquired in step S1 and the rotational speed detected in step S2 (step S3).

Next, the control unit 21C of the ECU 21 compares the rotational power F calculated in step S3 with the required rotational power, and controls the turning motor 24 such that the turning angle corresponds to the steering angle acquired in step S1 (step S5) when the rotational power F is equal to or greater than the required rotational power (step S4: NO).

On the other hand, when the rotational power F is less than the required rotational power and the rotational power is insufficient (step S4: YES), the control unit 21C of the ECU 21 controls the turning motor 24 such that the turning angle corresponds to the steering angle obtained in step S1 (step S6). Further, the control unit 21C controls the thruster motor of the thruster 40 according to a difference between the rotational power F and the required rotational power (step S7).

Specifically, in step S7, the control unit 21C of the ECU 21 increases a rotational speed of the thruster motor and increases the output (the propulsive force) of the thruster 40 as the difference between the rotational power F and the required rotational power is larger.

As described above, according to the outboard motor 20, the propulsive force of the thruster 40 is controlled based on the rotational speed of the propeller 27. Therefore, accurate and stable turning can be performed according to a traveling state of the boat 100.

For example, when the boat 100 is accelerating (the rotational speed of the propeller 27 is high), the thruster 40 is not operated, so that the hull 10 can be prevented from turning more than necessary. On the other hand, when the boat 100 is decelerating (the rotational speed of the propeller 27 is low), the thruster 40 is operated to compensate for the rotational power, so that the hull 10 can be turned in an intended direction. Additionally, even in a broaching state with a risk of overturning, the turning can be performed by performing the control shown in FIG. 4, and the boat 100 can be prevented from overturning.

In the above description, the thruster 40 is preassembled to the bow of the hull 10. However, the thruster 40 may be of a type which is suspended from the bow, for example. In a case of using this type of thruster 40, the control unit 21C of the ECU 21 changes the orientation of the thruster 40 in accordance with the steering angle of the steering device 35 when the control unit 21C of the ECU 21 controls the thruster 40 in step S7. Accordingly, the turning of the hull 10 can be more stably performed.

Figure 5:
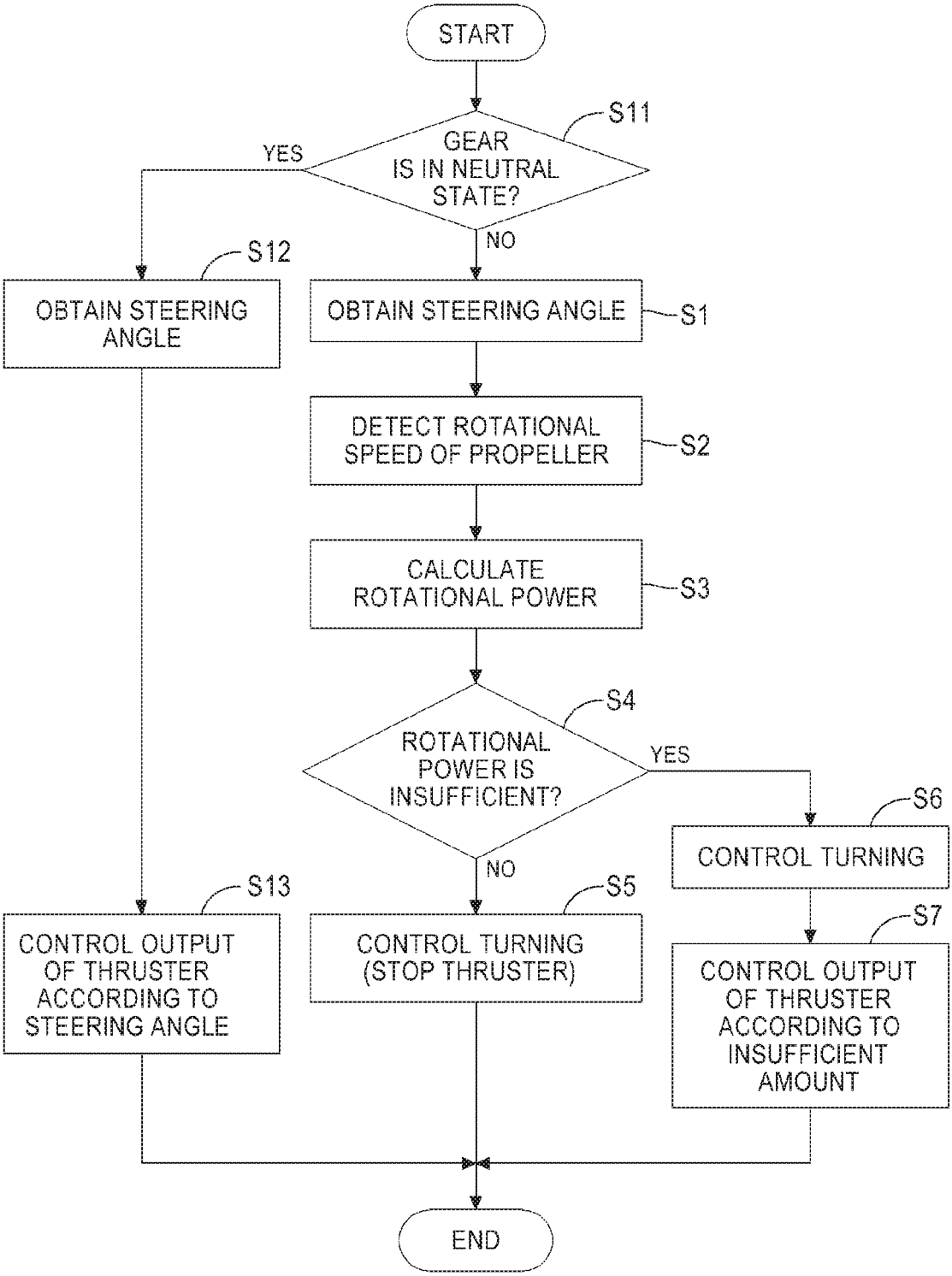
FIG. 5 is a flowchart for explaining an operation of the ECU shown in FIG. 3 according to a modification when the steering device is operated.

FIG. 5 is a flowchart for explaining an operation of the ECU 21 according to a modification when the steering device 35 is operated.

The flowchart shown in FIG. 5 is obtained by adding step S11, step S12 and step S13 to the flowchart of FIG. 4. In FIG. 5, the same processes as those in FIG. 4 are denoted by the same reference numerals, and the description thereof will be omitted.

When the steering device 35 is operated, the control unit 21C of the ECU 21 determines whether the gear of the outboard motor 20 is in the neutral state based on the operating position of the shift and throttle operating device 34 (step S11).

When the gear of the outboard motor 20 is not in the neutral state (step S11: NO), the processes of step S1 and subsequent steps described above are performed.

When the gear of the outboard motor 20 is in the neutral state (step S11: YES), the control unit 21C of the ECU 21 obtains the steering angle of the steering device 35 (step S12).

Then, the control unit 21C of the ECU 21 drives the thruster motor to control the propulsive force of the thruster 40 such that the turning angle corresponds to the steering angle (step S13).

The turning angle designated by the steering device 35 and the propulsive force of the thruster 40 are managed in advance in association with each other. The control unit 21C of the ECU 21 controls the propulsive force of the thruster 40 according to the managed information.

As described above, when the outboard motor 20 is in the neutral state, the turning of the hull 10 can be performed only by the thruster 40. Accordingly, moving toward a coast or a direction change of the boat 100 can be easily performed, for example.

Figure 6:
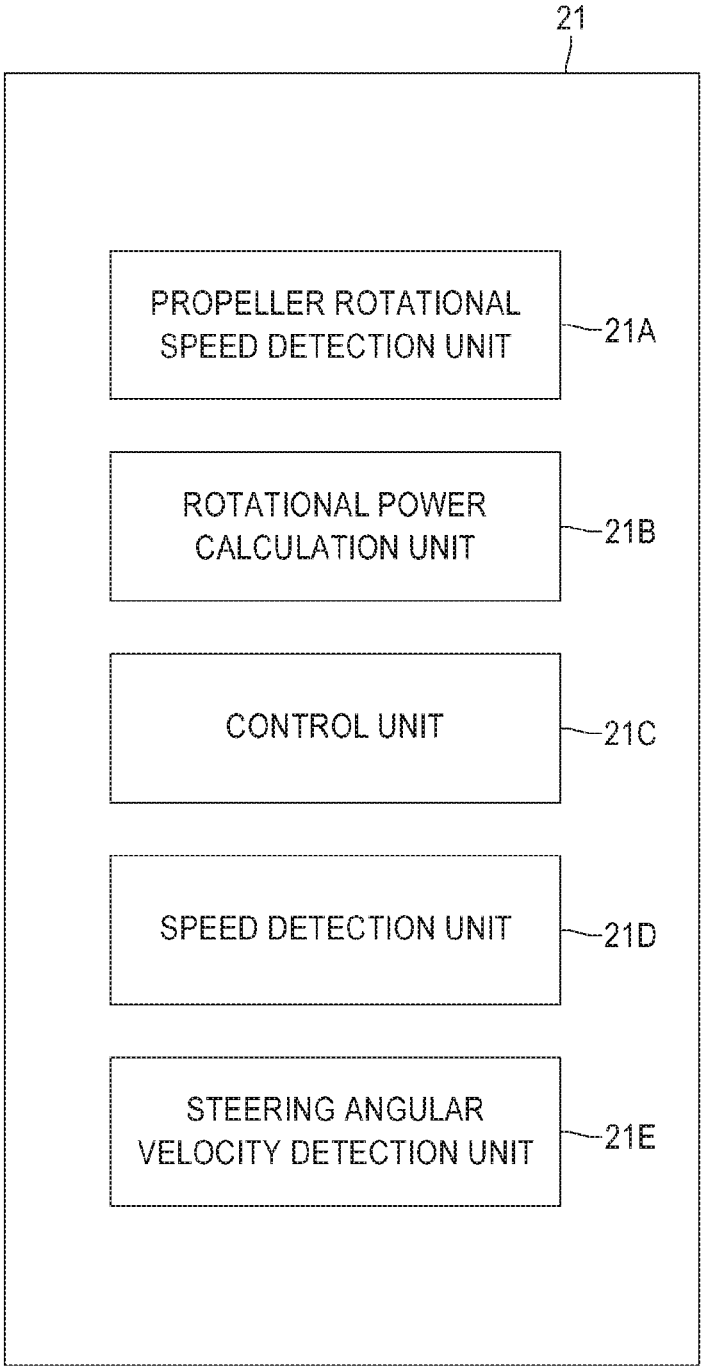
FIG. 6 shows functional blocks of the ECU shown in FIG. 3 according to a modification.

FIG. 6 shows the functional blocks of the ECU 21 shown in FIG. 3 according to a modification.

The ECU 21 according to the modification shown in FIG. 6 functions as the propeller rotational speed detection unit 21A, the rotational power calculation unit 21B, the control unit 21C, a speed detection unit 21D, and a steering angular velocity detection unit 21E by the processor executing a program stored in the built-in ROM and cooperating with various hardware of the outboard motor 20 and the boat 100.

The propeller rotational speed detection unit 21A has the same configuration as that of FIG. 3.

The speed detection unit 21D detects a traveling speed of the boat 100 based on a received signal transmitted from the GPS receiver 31 in FIG. 2.

The steering angular velocity detection unit 21E detects an angular velocity of a steering angle of the steering wheel 35*a* when the steering device 35 is operated, based on information of the steering angle sensor included in the steering device 35.

The control unit 21C controls the turning angle of the outboard motor 20 to a predetermined value when abrupt steering of the boat 100 is made during high-speed traveling, that is, when the steering wheel 35*a* is operated at an angular velocity equal to or greater than a predetermined second threshold value in a state where the traveling speed of the boat 100 is equal to or greater than a predetermined first threshold value. The predetermined value is set in advance to a value which is sufficiently small enough to prevent the boat 100 from overturning.

In addition to the function of the rotational power calculation unit 21B shown in FIG. 3, the rotational power calculation unit 21B has a function of obtaining the rotational power (hereinafter, referred to as a limited rotational power) of the boat 100 based on the rotational speed detected by the propeller rotational speed detection unit 21A and the predetermined value described above, in the case where the turning angle is controlled to the predetermined value described above.

The control unit 21C controls the output of the thruster 40 based on a difference between the required rotational power and the limited rotational power calculated by the rotational power calculation unit 21B.

Figure 7:
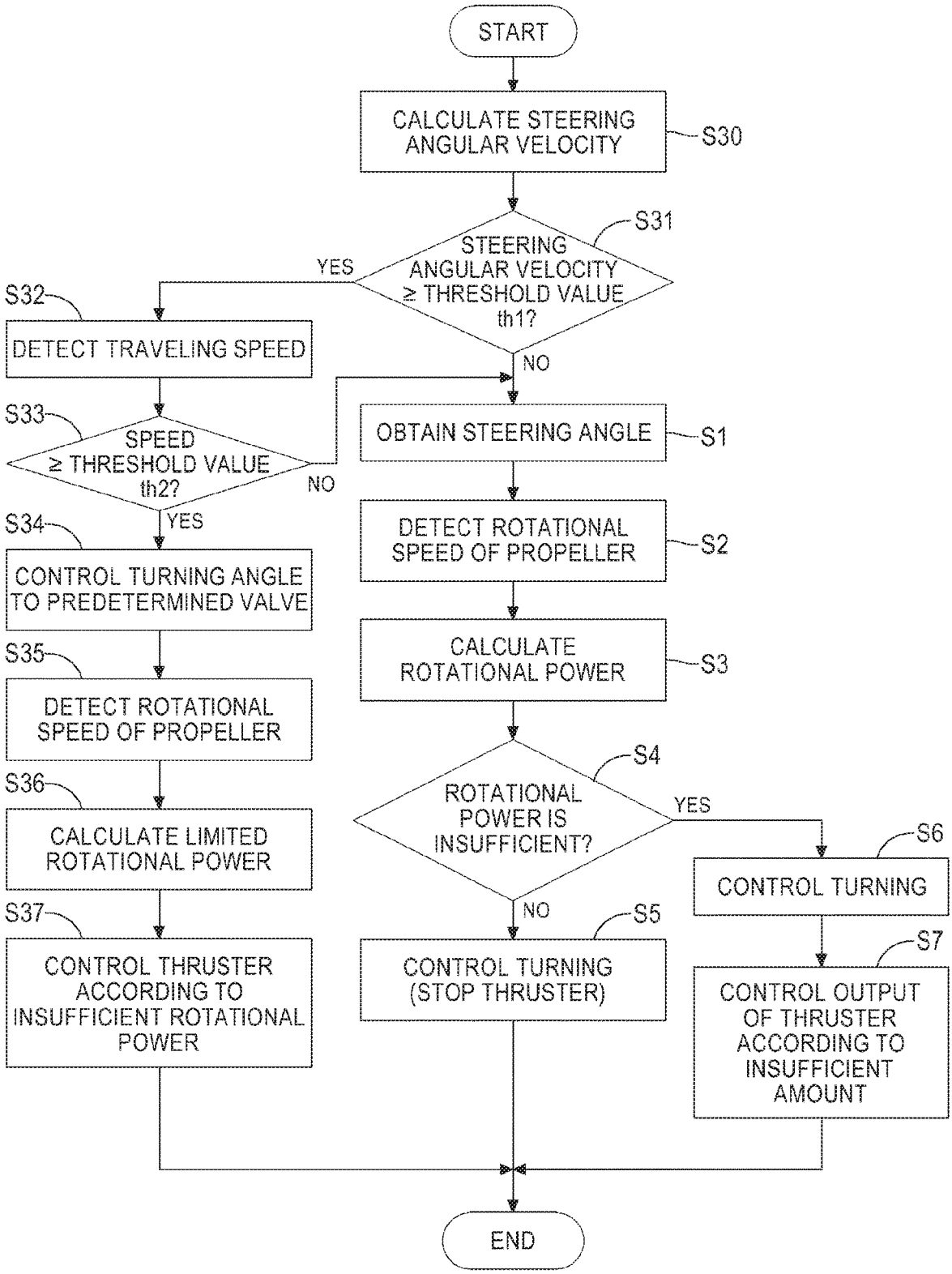
FIG. 7 is a flowchart for explaining an operation of an ECU shown in FIG. 6 when the steering device is operated.

FIG. 7 is a flowchart for explaining an operation of the ECU 21 shown in FIG. 6 when the steering device 35 is operated.

The flowchart shown in FIG. 7 is obtained by adding step S30, step S31, step S32, step S33, step S34, step S35 and step S36 to the flowchart shown in FIG. 4. In FIG. 7, the same processes as those in FIG. 4 are denoted by the same reference numerals, and the description thereof will be omitted.

When the steering device 35 is operated, the steering angular velocity detection unit 21E of the ECU 21 calculates the angular velocity of the steering angle based on detection information of the steering angle sensor included in the steering device 35 (step S30).

Next, the control unit 21C of the ECU 21 determines whether the angular velocity calculated in step S30 is equal to or greater than a first threshold value th1 (step S31).

When the angular velocity calculated in step S30 is less than the first threshold th1 (step S31: NO), the processes of step S1 and subsequent steps described above are performed.

When the angular velocity calculated in step S30 is equal to or greater than the first threshold value th1 (step S31: YES), the speed detection unit 21D of the ECU 21 detects the traveling speed of the boat 100 (step S32).

After step S32, the control unit 21C of the ECU 21 determines whether the traveling speed detected in step S32 is equal to or greater than a second threshold value th2 (step S33).

When the determination in step S33 is NO, the processes of step S and subsequent steps are performed.

When the determination in step S33 is YES, the control unit 21C of the ECU 21 controls the turning motor 24 to control the turning angle of the outboard motor 20 to the predetermined value described above (step S34). The predetermined value is set to a value smaller than a steering angle designated by the operation of the steering device 35, for example.

Next, the propeller rotational speed detection unit 21A of the ECU 21 detects the rotational speed of the propeller 27 (step S35).

Next, the rotational power calculation unit 21B of the ECU 21 calculates the limited rotational power of the boat 100 by the calculation of the equation (1) from the predetermined value described above of the turning angle controlled in step S34 and the rotational speed detected in step S35 (step S36).

Next, the control unit 21C of the ECU 21 subtracts the limited rotational power calculated in step S36 from the required rotational power to calculate the insufficient rotational power, and controls the output of the thruster 40 so as to obtain the insufficient rotational power (step S37).

Specifically, in step S37, the control unit 21C of the ECU 21 increases the rotational speed of the thruster motor to increase the output (the propulsive force) of the thruster 40 as the difference between the limited rotational power calculated in step S36 and the required rotational power is larger.

In the flowchart shown in FIG. 7, step S32 and step S33 may be performed before step S30, and when the determination in step S33 is YES, the processes of step S30 and subsequent steps may be performed. In this case, when the determination in step S31 is YES, the processes of step S34 and subsequent steps are performed.

As described above, according to the ECU 21 shown in FIG. 6, the turning angle is limited to the predetermined value even when abrupt steering of the boat 100 is made during the high-speed traveling, so that the boat 100 can be prevented from overturning. In addition, the output of the thruster 40 compensates for the insufficient rotational power due to the limited turning angle. Therefore, the turning of the hull 10 can be stably performed as intended.

The present invention is not limited to the embodiment described above, and modifications, improvements, or the like can be made as appropriate.

For example, in the boat 100 described above, the GPS receiver 31 may be built in the outboard motor 20. In addition, the outboard motor 20 may include the shift and throttle operating device 34 and the steering device 35. Further, the function of each of the blocks of the ECU 21 shown in FIG. 3 or FIG. 6 may be realized by a processor other than the outboard motor 20 mounted on the hull 10, a processor of a computer installed in the hull 10, or the like.

Although the boat 100 includes the outboard motor 20 as a first propulsion device, the outboard motor 20 may be replaced with an inboard motor. In addition, the outboard motor 20 or the inboard motor is not limited to one which operates with fuel such as gasoline, and may be one in which a propeller is rotated by an electric motor to obtain a propulsive force.

As described above, the following matters are disclosed in the present description.

(1) A boat maneuvering support device (for example, the ECU21 in the embodiment described above) is configured to support maneuvering of a boat (for example, the boat 100 in the embodiment) including: a first propulsion device (for example, the outboard motor 20 in the embodiment) which is mounted on a stern (for example, the stern 10*a* in the embodiment) of the boat and has a variable turning angle; a second propulsion device (for example, the thruster 40 in the embodiment) which is mounted on the boat and is configured to generate a propulsive force for moving the boat in a left-right direction; and a steering mechanism (for example, the steering device 35 in the embodiment) configured to change a turning angle of the first propulsion device and an output of the second propulsion device. The boat maneuvering support device includes:

a control unit (for example, the control unit 21C in the embodiment) configured to control at least one of the turning angle of the first propulsion device and the output of the second propulsion device according to an operation of the steering mechanism:

a rotational speed detection unit (for example, the rotational speed detection unit 21A in the embodiment) configured to detect a rotational speed of a propeller included in the first propulsion device; and a rotational power calculation unit (for example, the rotational power calculation unit 21B in the embodiment) configured to obtain a rotational power of the boat based on the turning angle designated by the operation of the steering mechanism and the rotational speed, wherein the control unit is configured to control the output of the second propulsion device based on the rotational power.

According to (1), the output of the second propulsion device is controlled based on the rotational power obtained based on the turning angle of the first propulsion device and the rotational speed of the propeller. Therefore, an accurate and stable turning operation can be performed regardless of a traveling situation of the boat.

(2) In the boat maneuvering support device according to (1), the control unit is configured to control the output of the second propulsion device based on a difference between a required rotational power required for turning the boat and the rotational power.

According to (2), since the output of the second propulsion device is controlled based on the difference between the required rotational power and the rotational power, the accurate and stable turning operation can be realized even in a traveling situation where the rotational power is insufficient.

(3) In the boat maneuvering support device according to (2), the control unit is configured to increase the output of the second propulsion device as the difference is larger in a state where the rotational power is smaller than the required rotational power.

According to (3), since the output of the second propulsion device is controlled to be higher as the difference between the required rotational power and the rotational power is larger, the accurate and stable turning operation can be realized even in the traveling situation where the rotational power is insufficient.

(4) In the boat maneuvering support device according to anyone of (1) to (3), the control unit is configured to control only the output of the second propulsion device to turn the boat when the steering mechanism is operated in a state where a gear of the first propulsion device is in a neutral state.

According to (4), since the turning can be performed only by the second propulsion device in the state where the gear is in the neutral state, an operation such as moving toward a coast or a direction change of the boat can be easily performed, for example.

(5) In the boat maneuvering support device according to anyone of (1) to (4), the control unit is configured to control the turning angle of the first propulsion device to a predetermined value when the steering mechanism is operated at an angular velocity equal to or greater than a second threshold value in a state where a traveling speed of the boat is equal to or greater than a first threshold value, the rotational power calculation unit is configured to obtain a second rotational power of the boat based on the rotational speed and the predetermined value, and the control unit is configured to further control the output of the second propulsion device based on a difference between the required rotational power required for turning the boat and the second rotational power.

According to (5), when the steering mechanism is rapidly operated in a state where the boat is traveling at a high speed, the turning angle is controlled to the predetermined value, so that the boat can be prevented from overturning. In addition, since the rotational power for controlling the turning angle is compensated by the output of the second propulsion device, the turning operation can be stably performed.

(6) In the boat maneuvering support device according to (5), the control unit is configured to increase the output of the second propulsion device as the difference between the required rotational power and the second rotational power is larger.

According to (6), the larger the difference between the required rotational power and the second rotational power, the higher the output of the second propulsion device, which makes it possible to smoothly turn the boat.

(7) An outboard motor includes:

the boat maneuvering support device according to any one of (1) to (6).

According to (7), since the outboard motor includes the boat maneuvering support device, it is not necessary to modify the boat or the like, and manufacturing cost of the boat can be prevented from increasing. In addition, since it is not necessary to separately prepare a boat maneuvering support device, a system can be easily introduced.

REFERENCE SIGNS LIST

100 boat
10 hull
10*a* stern
20 outboard motor
21 ECU
21A propeller rotational speed detection unit
21B rotational power calculation unit
21C control unit
21D speed detection unit
21E steering angular velocity detection unit
23 throttle motor
24 turning motor
26 shift motor
27 propeller
31 GPS receiver
34 shift and throttle operating device
34*a* shift and throttle lever
340 remote control box
35 steering device
35*a* steering wheel
40 thruster

The invention claimed is:

1. A boat maneuvering support device configured to support maneuvering of a boat including: a first propulsion device which is mounted on a stern of the boat and has a variable turning angle; a second propulsion device which is mounted on the boat and is configured to generate a propulsive force for moving the boat in a left-right direction; and a steering mechanism configured to change a turning angle of the first propulsion device and an output of the second propulsion device, the boat maneuvering support device comprising:

a control unit configured to control at least one of the turning angle of the first propulsion device and the output of the second propulsion device according to an operation of the steering mechanism;

a rotational speed detection unit configured to detect a rotational speed of a propeller included in the first propulsion device; and a rotational power calculation unit configured to obtain a rotational power of the boat based on the turning angle designated by the operation of the steering mechanism and the rotational speed, wherein the control unit is configured to control the output of the second propulsion device based on the rotational power.

2. The boat maneuvering support device according to claim 1, wherein the control unit is configured to control the output of the second propulsion device based on a difference between a required rotational power required for turning the boat and the rotational power.

3. The boat maneuvering support device according to claim 2, wherein the control unit is configured to increase the output of the second propulsion device as the difference is larger in a state where the rotational power is smaller than the required rotational power.

4. The boat maneuvering support device according to claim 1, wherein the control unit is configured to control only the output of the second propulsion device to turn the boat when the steering mechanism is operated in a state where a gear of the first propulsion device is in a neutral state.

5. The boat maneuvering support device according to claim 1, wherein the control unit is configured to control the turning angle of the first propulsion device to a predetermined value when the steering mechanism is operated at an angular velocity equal to or greater than a second threshold value in a state where a traveling speed of the boat is equal to or greater than a first threshold value, wherein the rotational power calculation unit is configured to obtain a second rotational power of the boat based on the rotational speed and the predetermined value, and wherein the control unit is configured to further control the output of the second propulsion device based on a difference between the required rotational power required for turning the boat and the second rotational power.

6. The boat maneuvering support device according to claim 5, wherein the control unit is configured to increase the output of the second propulsion device as the difference between the required rotational power and the second rotational power is larger.

7. An outboard motor comprising:

the boat maneuvering support device according to claim 1.

* * * * *